US007059082B2

(12) United States Patent
Barlow

(10) Patent No.: US 7,059,082 B2
(45) Date of Patent: Jun. 13, 2006

(54) MEMORIAL VASE INSERT ARTIFICIAL FLOWER AND HELIUM BALLOON HOLDER

(76) Inventor: Janice Barlow, 4512 W. Tacoma, Broken Arrow, OK (US) 74012

( * ) Notice: Subject to any disclaimer, the term of this patent is extended or adjusted under 35 U.S.C. 154(b) by 0 days.

(21) Appl. No.: 11/015,539

(22) Filed: Dec. 17, 2004

(65) Prior Publication Data

US 2005/0138860 A1 Jun. 30, 2005

Related U.S. Application Data

(60) Provisional application No. 60/532,675, filed on Dec. 24, 2003.

(51) Int. Cl.
*A01G 5/00* (2006.01)
*A01G 7/00* (2006.01)

(52) U.S. Cl. ..... 47/41.01; 47/41.12

(58) Field of Classification Search ..... 47/41.12
See application file for complete search history.

(56) References Cited

U.S. PATENT DOCUMENTS

| | | | | |
|---|---|---|---|---|
| 1,539,153 | A * | 5/1925 | Bennett | 47/41.11 |
| 3,369,321 | A * | 2/1968 | Blackistone, Jr. | 47/41.1 |
| 4,788,792 | A * | 12/1988 | Womick | 47/41.12 |
| D368,675 | S * | 4/1996 | Nix | D11/147 |
| 5,628,164 | A * | 5/1997 | Weder et al. | 53/397 |
| 6,067,748 | A * | 5/2000 | Williams | 47/41.01 |
| 6,092,330 | A * | 7/2000 | Pratt | 47/41.1 |
| 6,128,855 | A * | 10/2000 | Salamh et al. | 47/41.01 |
| 6,170,193 | B1 * | 1/2001 | Wright et al. | 47/41.1 |
| 6,178,688 | B1 * | 1/2001 | Keating | 47/41.12 |
| 6,185,863 | B1 * | 2/2001 | Tabbert | 47/41.12 |
| 6,478,651 | B1 * | 11/2002 | Weir | 446/220 |
| D502,889 | S * | 3/2005 | Broel | D11/143 |

FOREIGN PATENT DOCUMENTS

JP 3573042 B2 * 10/2004

* cited by examiner

*Primary Examiner*—Francis T. Palo
(74) *Attorney, Agent, or Firm*—Martin S. High, P.C.

(57) ABSTRACT

The instant invention allows the reuse of the insert to replace old flower arrangements with new ones. The instant invention is comprised of foam that is fan folded with folded edges on the topside insert. This fan folded foam is firmly inserted into the insert. Artificial flowers are inserted into the instant invention by placing floral stems between the foam layers that are capable of holding various sizes of floral stems and wooden or metal dowels for decorative ornaments such as flags. Artificial flower stems can be removed and reinserted into the foam layers without placing holes in foam layers making multiple reuse practical. The instant invention is superior to floral and craft foam which is traditionally used. The use of medium and large sleeves allows the vase insert to fit various sizes of memorial vases. The instant invention also provides a convenient and novel means of holding helium balloons.

4 Claims, 9 Drawing Sheets

MEMORIAL VASE INSERT ARTIFICIAL FLOWER AND HELIUM BALLOON HOLDER

CROSS-REFERENCE TO RELATED APPLICATIONS

This application claims the benefit of U.S. Provisional Application No. 60/532,675 filed on Dec. 24, 2003 titled "Memorial Vase Insert Artificial Flower and Helium Balloon Holder," which is incorporated herein by reference.

STATEMENT REGARDING FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE OF THE MATERIAL ON THE COMPACT DISC.

Not applicable.

BACKGROUND OF THE INVENTION

For years the use of floral and craft foam cones have been standard for holding artificial flowers in memorial vases. One example of floral and craft foam used in memorial vases is polystyrene foam. Regularly, the floral and craft markets polystyrene foam use white or green foams. The floral and craft foams come in many sizes, shapes, and price ranges and have a variety of uses. In most cases the placement of artificial flowers in memorial vases, floral and craft polystyrene foam is performed using cone sizes of 4"×2½", 6"×3", and 9"×4". Foamed polymeric materials, such as polystyrene foam marketed under the trademark STYROFOAM®, is commonly used to secure the flowers and is the most widely used floral and craft foam on the market. For the purposes of this disclosure, the use of specific types of polystyrene foam and floral and craft foam components and elements are for illustration purposes only and are not to limit the scope of invention.

As is the case with all portions of this specification, the foregoing background information is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. No portion of the background information is intended to restrict the scope of the invention which is measured by the claims, in any way. Yet, the background is intended to provide information to fully understand the claims with the broadest possible perspective.

Various problems occur when using conventional floral and craft foam cones to secure flowers in memorial vases. Memorial vases are the receptacles found near or in grave markers at cemeteries and memorial gardens used to contain flowers, either natural or artificial flowers. If the user does not know the memorial vase-opening dimension, the user will be required to guess the size of cone to purchase. If selected cone is too small for the memorial vase, the cone will not fit in the memorial vase properly resulting in several possible inappropriate scenarios: the floral arrangement will fall too deeply inside memorial vase, losing the desired arrangement appearance; the cone may lean to one side of memorial vase, causing the arrangement to be unbalanced; wind may cause the floral arrangement to spin around inside memorial vase; finally, the flower arrangement may be blown out of memorial vase by the prevailing winds. Flower arrangements blown out of memorial vases result in additional work for cemetery groundskeepers because they are responsible for picking up fallen flower arrangements. Groundskeepers must dispose of the arrangement because they cannot assume it belongs to any one particular memorial vase.

If the cone is too large for memorial vase, it may protrude out the top of the memorial vase, which is visibly unpleasant, or the cone will require cutting in order to fit inside memorial vase. It is common to insert artificial flowers in the floral and craft foam cone prior to visiting the cemetery. If the cone is too large, it is likely the outer edges or bottom stems of artificial flowers will need to be removed from the cone so the cone can be cut accordingly. Once the cone has been cut, the artificial flowers can be reinserted into the floral and craft foam cone.

Another problem when using floral and craft foam cones are that holes are created in the foam when flower stems are inserted into floral and craft foam cones. It is common for the user to repeatedly insert and remove stems and/or bushes to achieve the desired arrangement result. This procedure likely results in the enlargement of the original holes and/or additional new holes in the cone. Often stems are not inserted at a straight angle into the cone, which results in floral stems protruding out the sides or bottom of the cone. As a result, the stems must be removed and reinserted, leaving additional holes in the cone or making the original holes too large to adequately support artificial flowers. When stems are inserted through the sides and bottom of the cone, holes are left penetrating completely through the cone. When this occurs, tiny pieces of foam escape through the holes made in the cone causing foam pieces to fall on the users work surface. The cone may also be damaged in a manner that it could cause large chunks of cone to break off. Cleaning up this debris is a messy and time consuming process. When used in memorial vases, floral and craft foam cones have a short lifespan because harsh weather conditions and ultraviolet light cause the foam to disintegrate. Due to this disintegration, it is common after each use to dispose of the cones. Therefore, even when the proper size floral and craft foam cone is inserted into the memorial vase, its lifespan is limited. In sum, there are significant drawbacks in using polystyrene or other polymer foams to secure flowers in memorial vases.

The instant invention provides an economical method for displaying artificial flowers in memorial vases since it can be reused over and over again. The instant invention saves money because it eliminates the need to repurchase the invention each time a new arrangement is created. Travel expenses are reduced because unnecessary trips to the store to purchase new floral and craft foam will be eliminated. This not only saves the user money, but also their time. It is common to find new flower arrangements in memorial vases for the following occasions; Valentines Day, Easter, Memorial Day, Mother's Day, Father's Day, Fourth of July, Thanksgiving, Christmas, birthday of deceased, and death anniversary of deceased. New floral and craft foam would need to be purchased for each of these ten occasions. This would either result in finding the space to store the additional floral and craft foam cones or wasting gasoline and time by making additional trips to the store to purchase the cones.

Another problem with using floral and craft foam is the lack of a method for securing balloons to memorial vases. Balloons are frequently added to flower arrangements in memorial vases to remember special occasions of the deceased such as birthdays. The user must use his/her imagination to find a way to securely hold helium balloons in the vase. Often the balloons are tied onto one of the artificial flower stems in the floral and craft foam. This provides unnecessary stress on the artificial flower stem and leads to potential loss of the flower and damage to the arrangement.

There is a need for a better solution for holding artificial flowers and helium balloons in memorial vases because:

- Users are often confused as to what size floral and craft foam to purchase.
- Cones that are purchased too small may result in loosing the desired artificial arrangement appearance, an unbalanced arrangement, the wind spinning the arrangement around inside memorial vase, and the arrangement may be wind blown out of the memorial vase.
- Cones that are purchased that are too large may protrude out the top of memorial vase and the cone may require cutting.
- Holes are created in the foam which results in unbalanced and unsecured floral arrangements after repeated use.
- The removal and re-insertion of artificial flower stems result in further cone destruction.
- Cleaning up foam debris is a messy and time-consuming process.
- Harsh weather conditions cause foam disintegration.
- Floral and craft foam cones are likely to be replaced for each new artificial flower arrangement.
- There is a lack of a method for tying on helium balloons to floral and craft foam.

BRIEF SUMMARY OF THE INVENTION

The general purpose of the instant invention, which will be described subsequently in greater detail, is to provide a reusable device that fits various sizes of memorial vases for the purpose of holding artificial flowers and helium balloons. In view of the foregoing disadvantages inherent in the known types and uses of conventional prior art, the instant invention was developed as a new device and method of holding artificial flowers and helium balloons in memorial vases. The instant invention has many advantages and novel features over the prior art, that results in a new method and reusable device specifically designed for the purpose of holding artificial flowers and helium balloons in various sizes of memorial vases.

The instant invention, the memorial vase insert, described herein is functionally superior to conventional floral and craft foam methods. Unlike floral and craft foam, this invention is comprised of vertical foam layers that can be reused due to the method of placing floral stems in between the foam layers, thereby eliminating holes made from inserting floral stems directly into floral and craft foam cones. The foam layers are formed by taking a linear sheet of foam and folding the sheet repeatedly forming a lamellar structure. The foam layers in turn hold the artificial flowers in place securely, neatly, and attractively and provide an improved alternative to the common method of floral and craft foam cones. In contrast to floral and craft foam cones fabricated from polystyrene foam, when inserted in the inventive device floral stems will not leave holes in between the foam layers. When floral stems are inserted into floral and craft foam cones, holes are created in the cones. The flowers can easily be removed and reinserted in between the inventions foam layers without leaving holes in the foam. In addition, this process eliminates the mess that comes from floral and craft foam debris.

Using the instant invention, it is possible to insert the artificial flowers before the device is placed inside of the memorial vase, and the flower stems will not require cutting prior to the insertion process. Once flower stems are inserted into the instant invention, the stems can be cut from the bottom opening omitting the need to measure the stems length, which in turn saves the user time. When using floral and craft foam cones, if the flower stems require cutting, the user must measure and cut the stems prior to insertion into the cone.

The instant invention is designed to fit various sizes of memorial vases, alleviating the guesswork out of deciding which size floral and craft foam cone to purchase. The result is a more attractive, secure and stable flower arrangement in the memorial vase. In addition, it helps simplify the work of cemetery groundskeepers by eliminating the need to pick up pieces of worn, broken off floral and craft foam from cemetery grounds. The need to pick up floral arrangements that have blown out of memorial vases due to improper sizing will be far less likely.

Unlike floral and craft foam devices, this invention provides two or more balloon holders. These convenient and novel balloon holders are a much needed solution to the problem of tying on balloons, particularly helium balloons, in memorial vases. When using floral and craft foam, the user must use his/her imagination to solve the problem of where to tie on helium balloons.

When compared to conventional methods and devices used for holding artificial flowers in memorial vases, the invention described can be reused without requiring replacement after each floral arrangement. Because this invention provides sleeves to fit various sizes of memorial vases, the guesswork is alleviated in deciding which size floral and craft foam cones to purchase. The mess of cutting floral and craft foam that is too large to fit inside a memorial vase is eliminated.

There has thus been outlined, rather broadly, the more important features of the inventive device in order that the detailed description thereof may be better understood, and in order that the present contribution to the art may be better appreciated. There are additional features of the inventive device that will be described hereinafter.

A primary objective of the inventive device is to provide a reusable device to display artificial flowers in memorial vases. Another objective of the inventive device is to provide a method to display helium balloons in memorial vases. Another objective of the inventive device is to provide a device that is designed to fit various sizes of memorial vases, alleviating the guesswork out of what size Floral and craft foam to purchase. In these respects, the inventive device substantially departs from the conventional concepts and designs of the prior art, and in so doing presents a reusable device that offers a unique approach using vertical layers of foam to hold artificial flowers securely, neatly, and attractively in memorial vases. The medium and large foam sleeves allow the invention to fit various sizes of memorial vases, in addition novel balloon holders' offer a much needed, convenient solution to tie on helium balloons.

To accomplish the above and related objectives, the instant invention may be embodied in the form illustrated in the accompanying drawings, attention being called to the fact, however, that the drawings are illustrative only, and that changes may be made in the specific construction illustrated.

BRIEF DESCRIPTION OF THE SEVERAL VIEWS OF THE DRAWING

Various other objects, features and attendant advantages of the inventive device will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
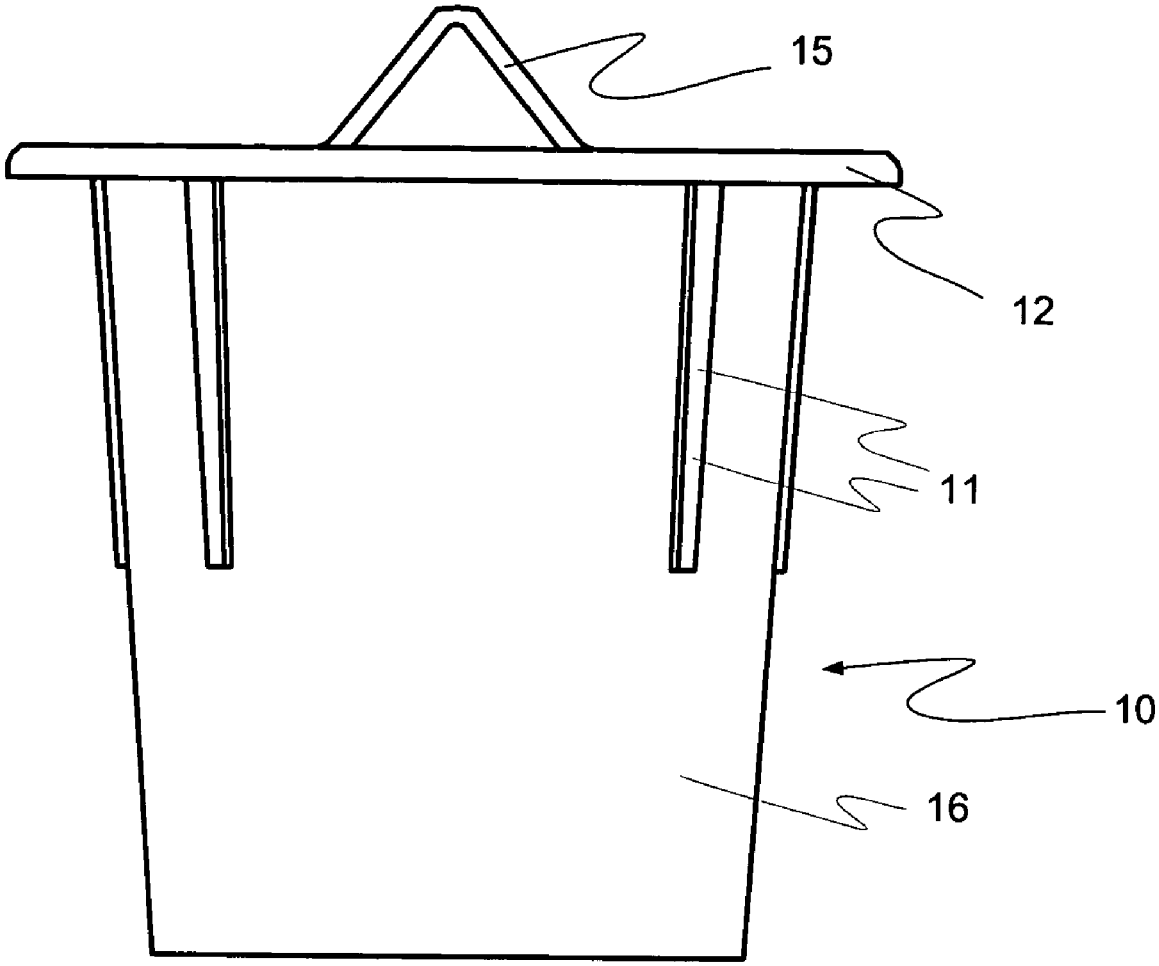
FIG. 1 shows a side view of an embodiment of the vase insert.
Figure 2:
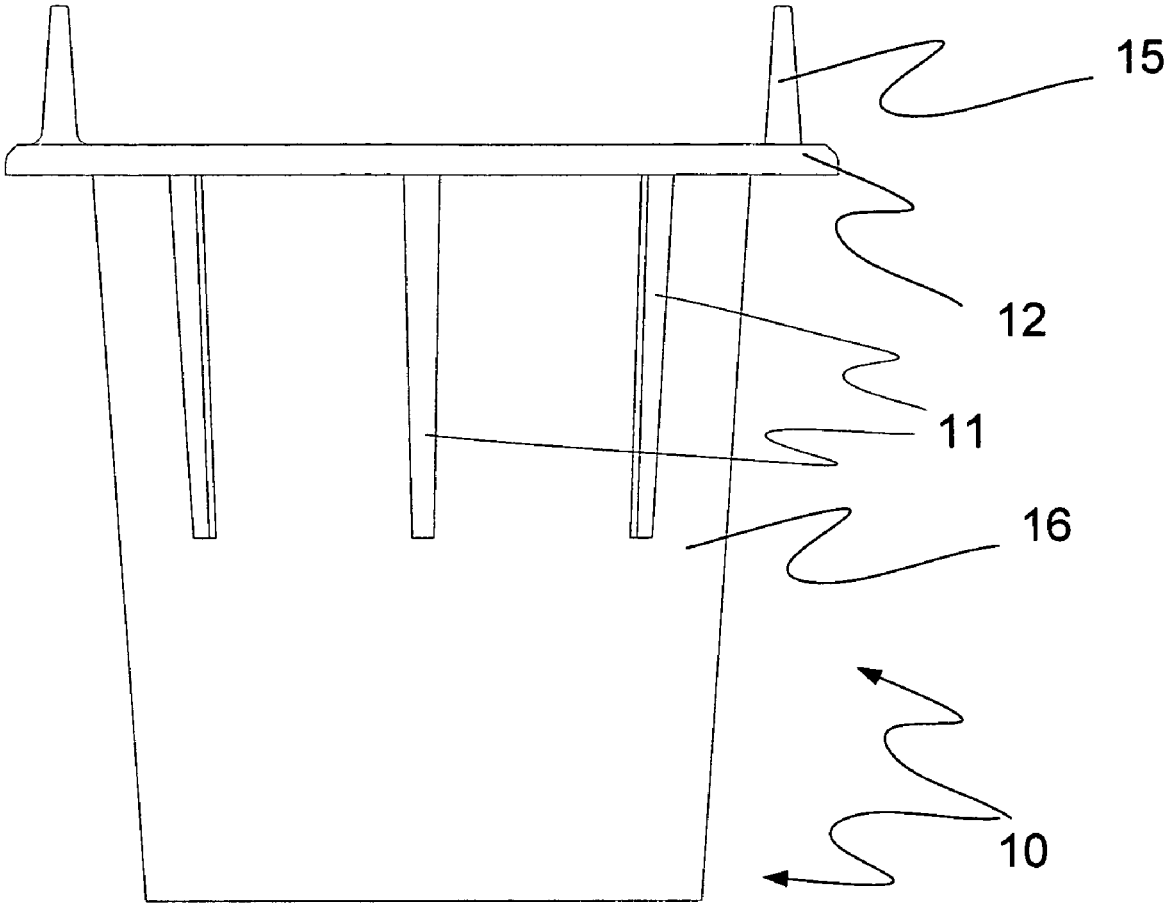
FIG. 2 shows another side view of an embodiment of the vase insert.
Figure 3A:
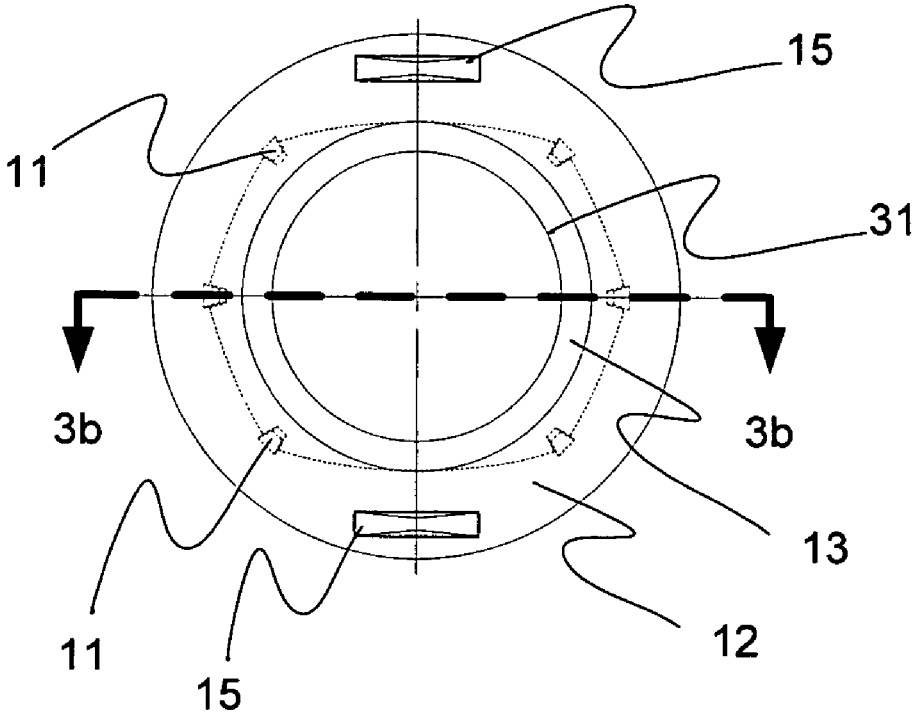
FIG. 3*a* shows a top view of an embodiment of the vase insert.
Figure 3B:
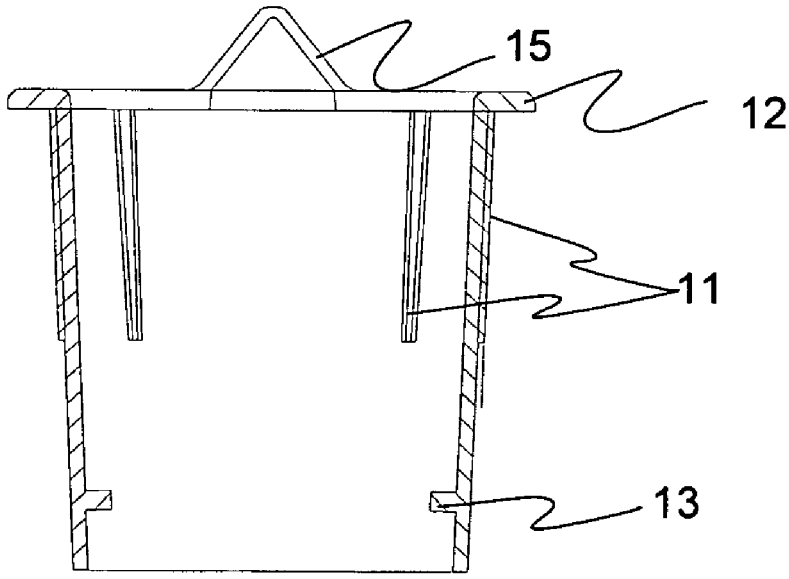
FIG. 3*b* shows a sectional side view of an embodiment of the vase insert.
Figure 4:
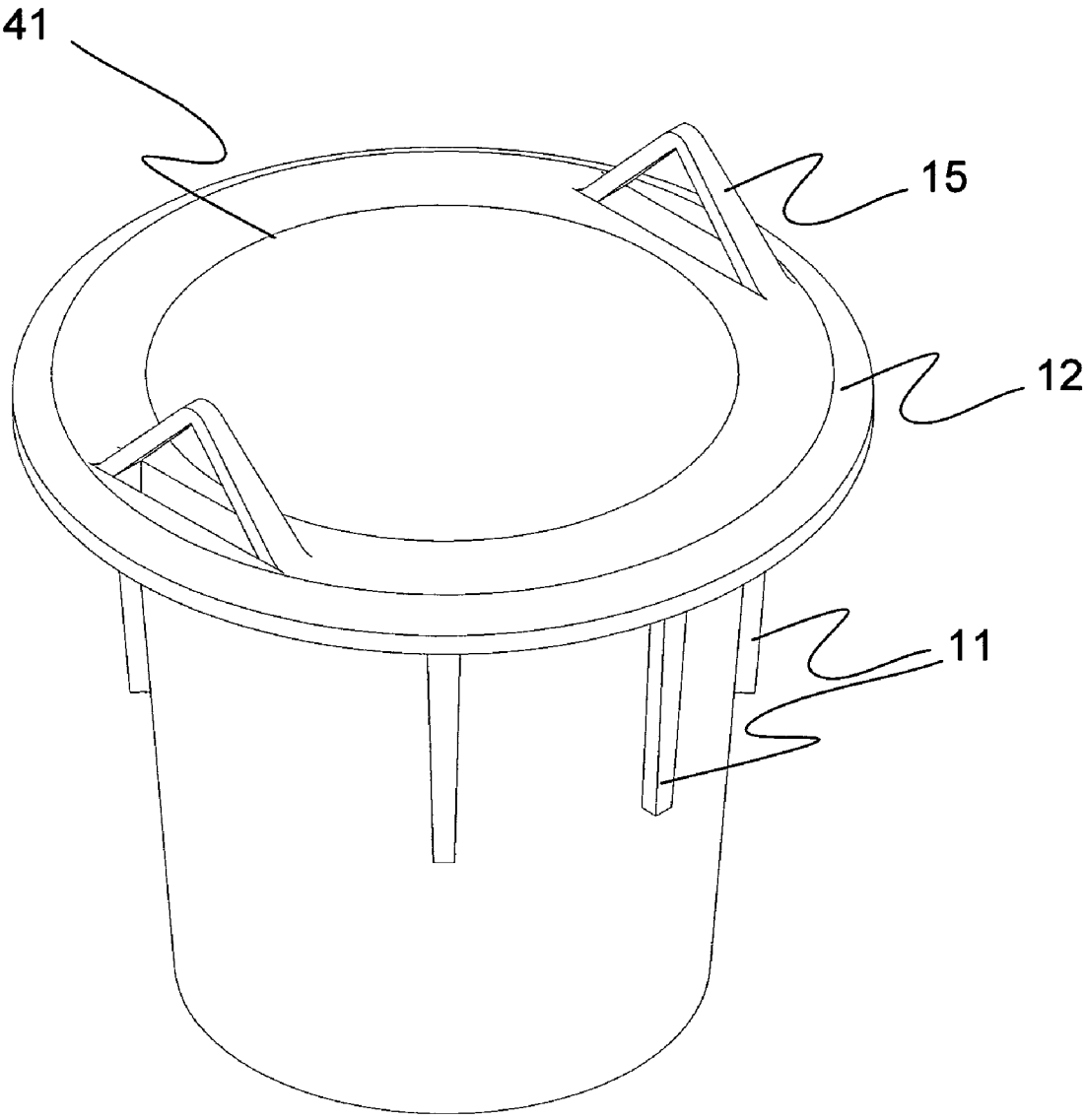
FIG. 4 shows an isometric view of an embodiment of the vase insert.
Figure 5A:
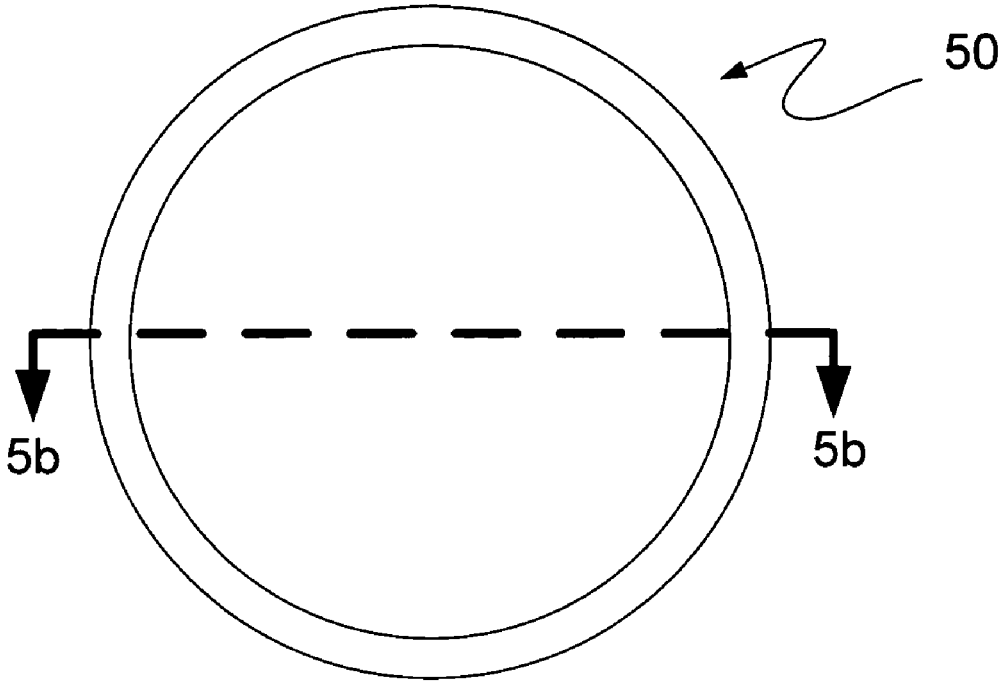
FIG. 5*a* shows a top view of an embodiment of a medium sleeve.
Figure 5B:
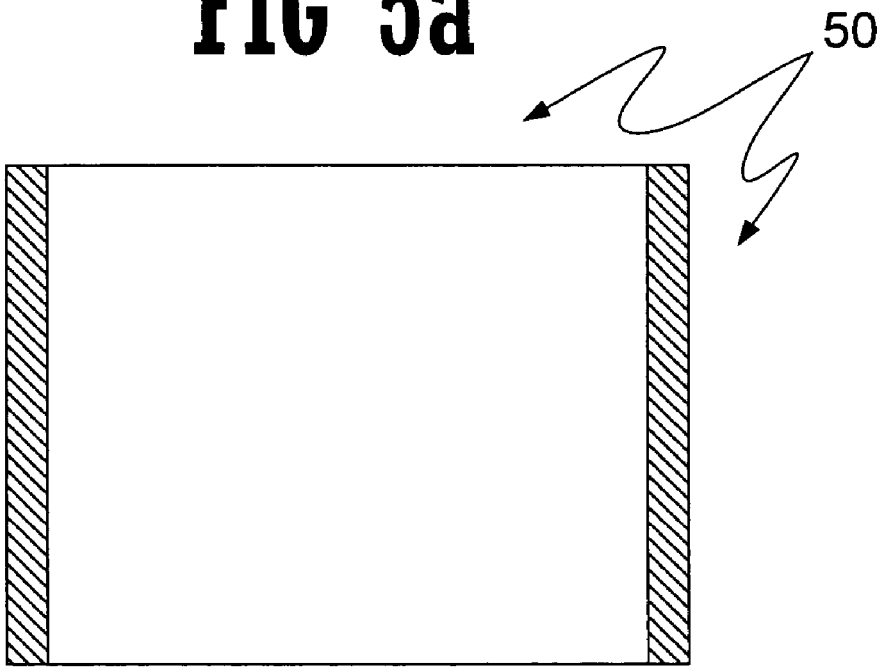
FIG. 5*b* shows a sectional side view of an embodiment of a medium sleeve.
Figure 6A:
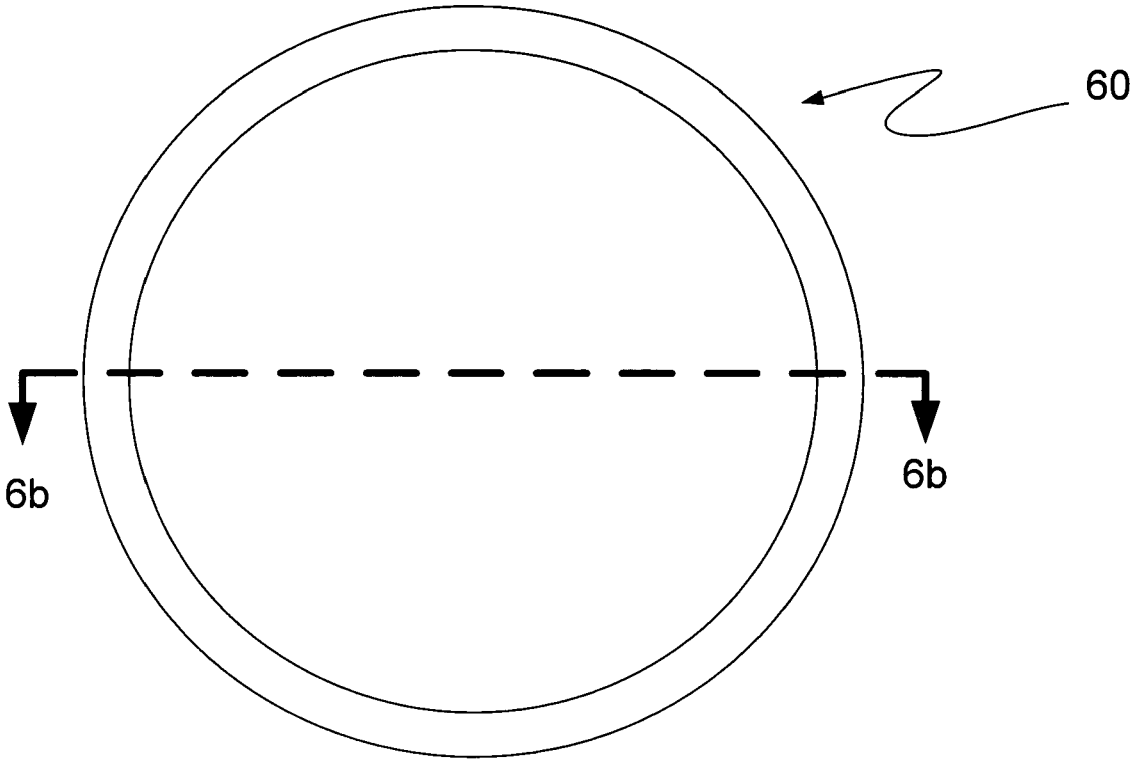
FIG. 6*a* shows a top view of an embodiment of a large sleeve.
Figure 6B:
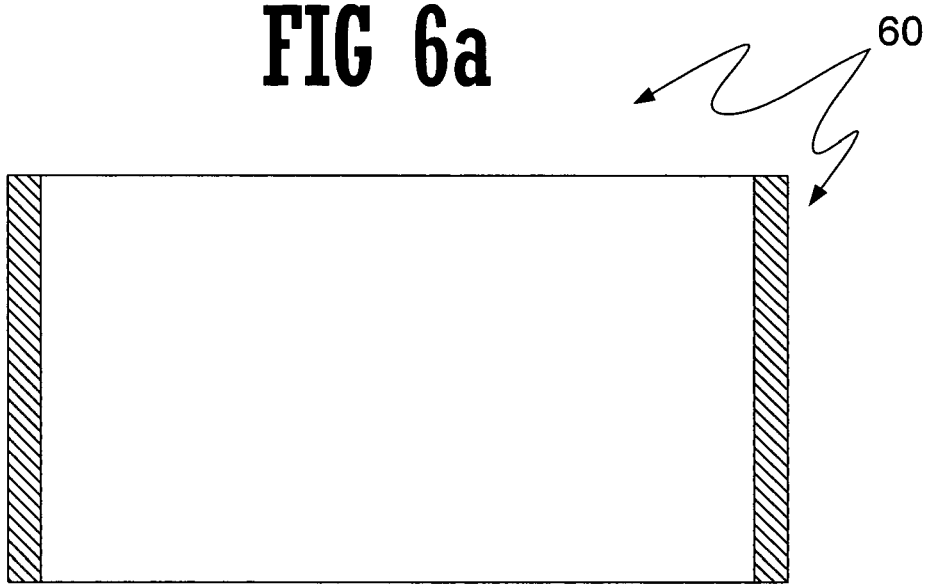
FIG. 6*b* shows a sectional side view of an embodiment of a large sleeve.

Turning now descriptively to the drawings, in which similar reference characters denote similar elements throughout the several views, the attached figures illustrate a reusable inventive device that holds artificial flowers and helium balloons in various sizes of memorial vases. FIG 1 shows the perspective side view of the embodiment of the vase insert 10. The vase insert 10 is comprised of a vase insert body 16, vase insert wedges 11, a vase insert rim 12, a bottom rim lip 13, foam layers 70, and helium balloon holders 15. For manufacturing purposes these parts can be separate and independent of each other. The vase insert body 16 is a generally cylindrical shape with a slight taper from the larger diameter at the top of the vase insert body 16 where the vase insert rim 12 is located to the smaller diameter at the bottom of the vase insert body 16. The bottom of the cylindrical vase insert body 16 forms a circular bottom opening 31 slightly smaller than the outside diameter of the bottom of the vase insert. This bottom opening allows the flower stems to pass through to the outside of the vase insert. The flower stems can then be easily trimmed to length.

The vase insert body 16 also forms a circular top opening 41 that allows for insertion of the foam layers 70 described below that hold the flower stems inserted into the vase insert. One embodiment of the sleeves is a medium sized sleeve, and another embodiment is a large sized sleeve. The sleeves are important to the instant invention because they allow the vase insert to fit securely in various sizes of memorial vases. Balloon holders 15 are located on the vase insert rim 12 to allow for securing balloons to the instant invention 10.

The foam layers 70 are comprised of polymeric foam material. In one embodiment of the instant invention, the polymeric foam layers 70 are manufactured from polyethylene foam. In yet another embodiment, the foam layers are manufactured from polyurethane foam. The foam layers 70 hold the artificial flower stems in between the layers of foam and are secured through a resistance fit between the foam layers 70 and the flower stems. This is important to the instant invention because inserting artificial flower stems in between the foam layers 70 instead of directly into or through the foam layers allows the invention to be reusable.

Figure 7:
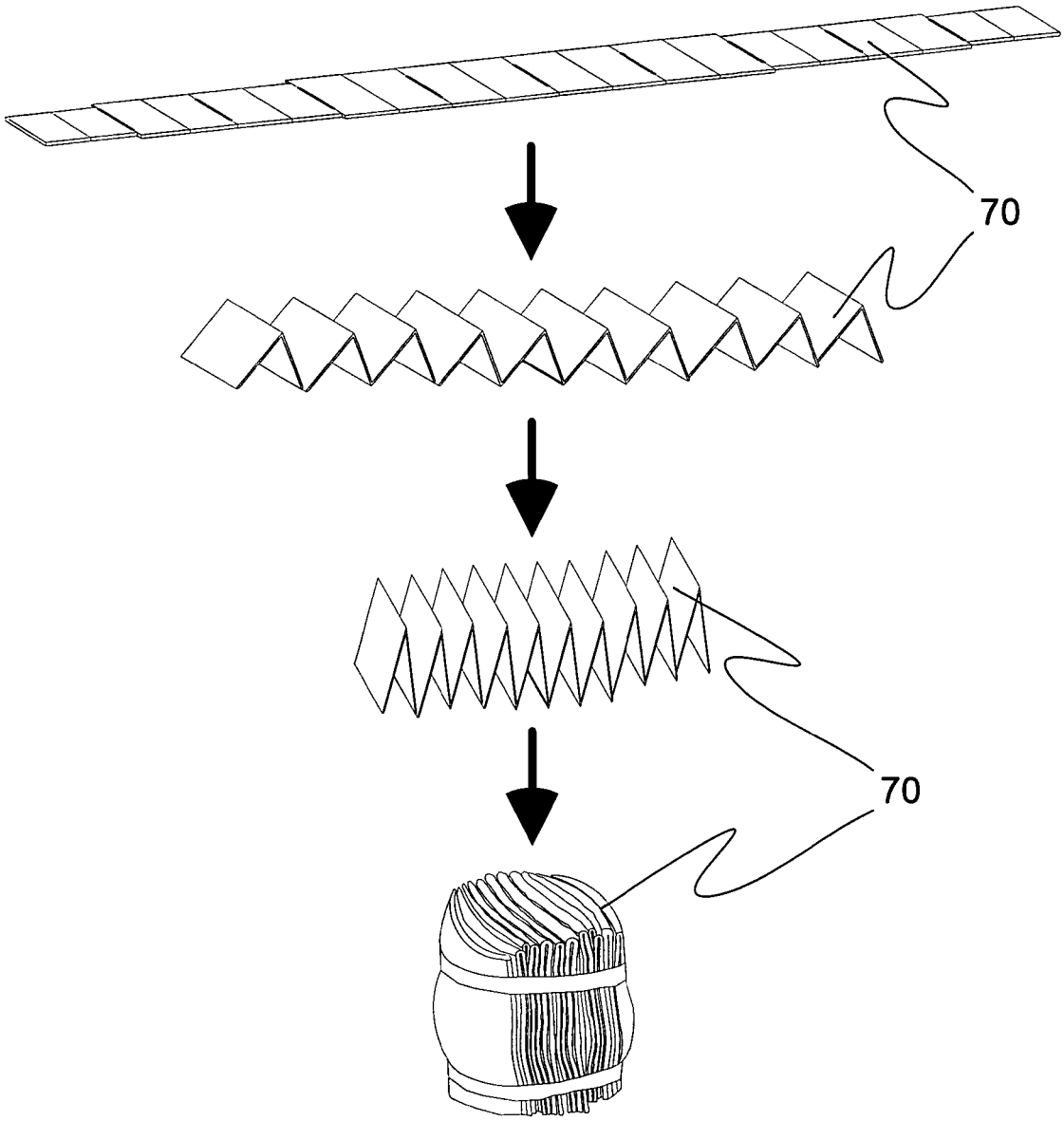
FIG. 7 shows a top view of an embodiment of a foam insert shown unfolded and illustrates how the folded foam insert is formed.
Figure 8:
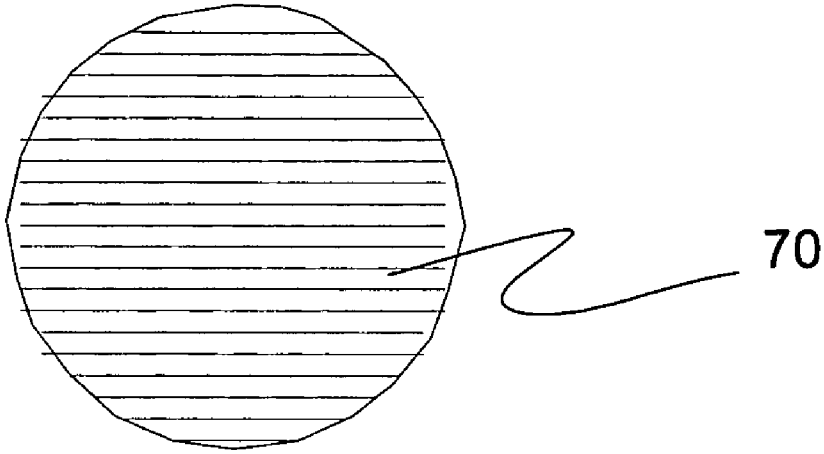
FIG. 8 shows a top view of an embodiment of a foam insert with a plastic band.
Figure 9:
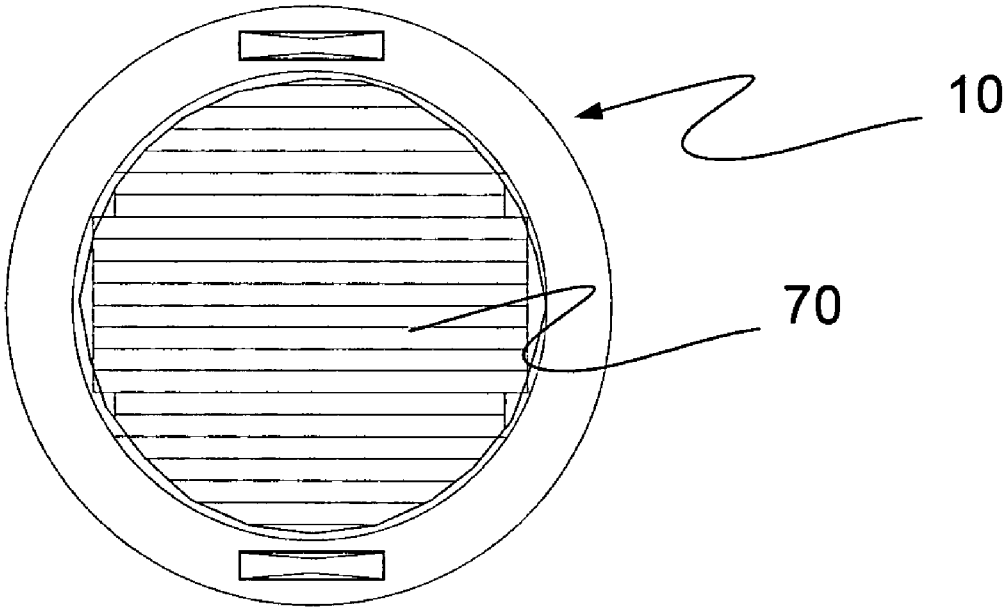
FIG. 9 shows a top view of an embodiment of the foam insert shown inside of vase insert.
Figure 10:
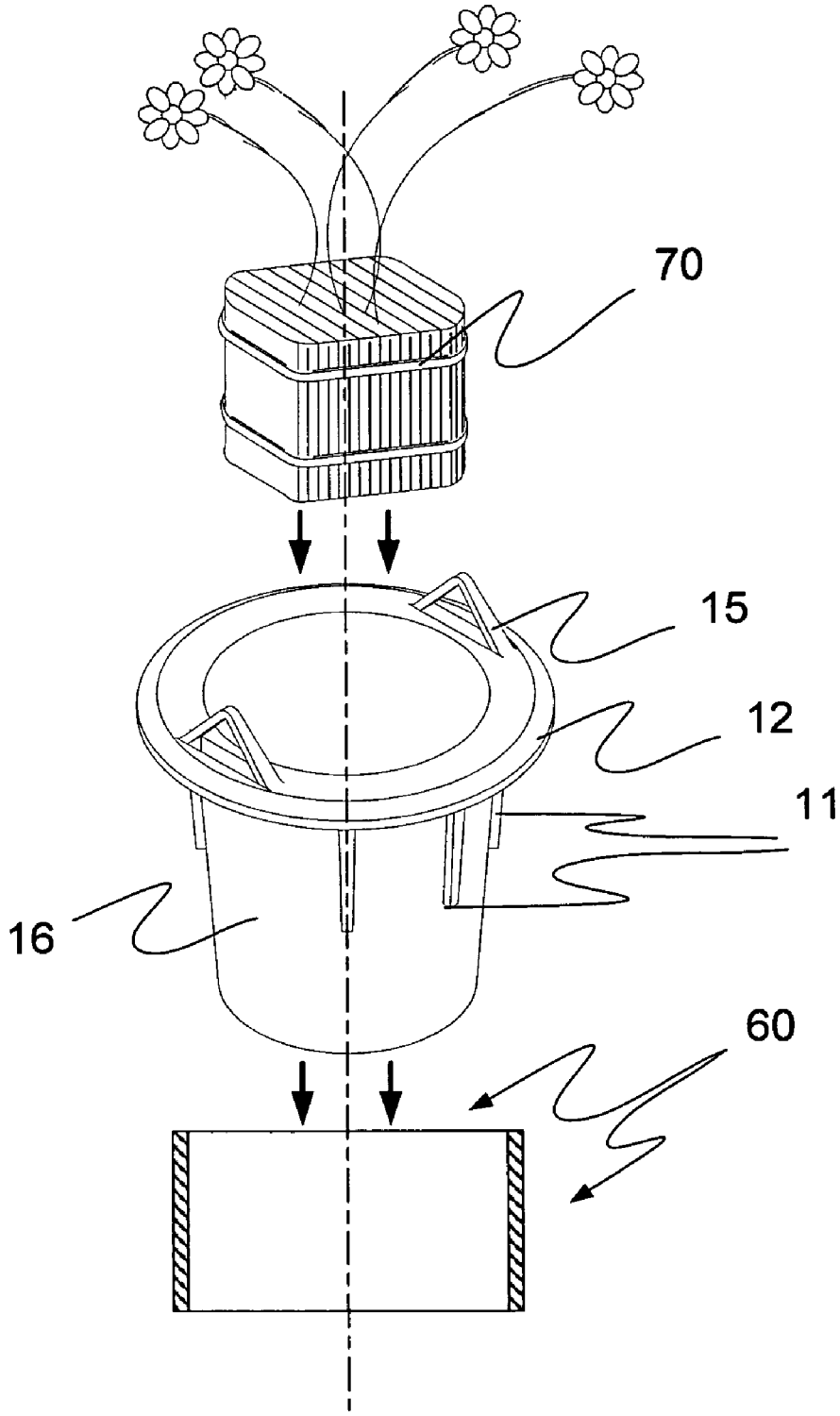
FIG. 10 shows how the folded foam insert is inserted into the vase insert which is in turn inserted into a sleeve.

As illustrated in FIG. 7, the foam insert is comprised of essentially a long thin strip of foam with regularly spaced folds. Alternating folds in the foam insert form apertures which progress only partially across the fold and are centered along a fold. FIG. 7 illustrates how the slits do not extend all the way across the width of the foam so as to not separate the foam into segments. As the foam is folded, the folds with the apertures are arranged so that the apertures are located in the bottom folds. As flower stems are inserted into the foam insert, stems longer than the vase insert pass downward between the foam folds, through the apertures, through the bottom opening to the outside of the vase insert. The flower stems can be easily trimmed to length at the bottom of the vase insert.

The vase insert is further comprised of a vase insert rim 12 that serves to hold vase insert 10 on top edge of memorial vase. The vase insert rim 12 is continuously formed from the vase insert body 16 on the top surface of the vase insert 10 and protrudes from the vase insert body 16 in the same plane as the top opening 31. This is important to the present invention because it allows the vase insert 10 to be utilized in various sizes of memorial vases. The embodiment of the vase insert 10 includes a vase insert rim 12 that serves to hold vase insert 10 on top edge of memorial vase. This is important to the present invention because it allows the Vase Insert to be utilized in various sizes of memorial vases.

The vast insert is further comprised of vase insert wedges 11 which are formed on the outside surface of the vase insert body 16. The vase insert wedges 11 provide a resistance fit between the medium sleeve 50 and the vase insert wedges 11 via contact between the vase insert wedges 11 and the inside surface of the sleeve 50. The sleeves are important to the present invention because they allow the vase insert 10 to fit securely in various sizes of memorial vases. The vase insert wedges also serve to aid in the insertion and removal of the vase insert since the vase insert wedges prevent the formation of a vacuum inside the memorial vase.

The medium sleeves 50 and large sleeves 60 may be manufactured separately. The medium sleeves 50 and large sleeves 60 are essentially thin walled cylindrical structures manufactured from a compliant polymeric material. In one preferred embodiment of the invention, the medium sleeves 50 and large sleeves 60 are manufactured from polyethylene foam. The medium sleeves 50 and large sleeves 60 are important to the present invention because they allow the vase insert 10 to fit securely in various sizes of memorial vases. The medium sleeve 50 is used in combination with the memorial vase insert. Once inserted around the vase insert 10, the medium sleeve 50 provides a more secure fit inside the memorial vase. The medium sleeve 50 is placed over the outside of the vase insert 10 and the entire assembly is inserted into the ground into the memorial vase. If the opening of the memorial vase holder is even larger, the large sleeve 60 can be placed over the medium sleeve 50 which, again, is placed over the vase insert. The large sleeve 60 is used in combination with the medium sleeve 50 and vase insert 10. Once inserted around the vase insert 10 and medium sleeve 50, the large sleeve 60 provides a more secure fit inside the appropriate size memorial vase. This larger diameter can then fit snugly into the memorial vase holder. The medium sleeve 50 and the large sleeve 60 are manufactured from a rigid polymeric foam. In a preferred embodiment of the instant invention the medium sleeve 50 and large sleeve 60 are manufactured from polyethylene foam.

The vase insert is further comprised of a plurality of balloon holders 15 located on the vase insert rim 12. The plurality of balloon holders 15 serves as an anchor point for balloons, particularly helium balloons, to be affixed to the vase insert. In one preferred embodiment of the instant invention, there are two balloon holders 15 located on the vase insert rim 12.

The instant invention is also comprised of foam layers 70 which are inserted into the vase insert 10 that hold artificial flower stems in between layers of foam. These foam layers 70 are constructed in a fan-folded, lamellar structure. The foam layers 70 are manufactured from compliant polymeric materials. In one preferred embodiment of the instant invention, the foam layers 70 are manufactured from polyethylene foam. The foam layers 70 are important to the present invention because inserting artificial flower stems between the foam layers 70, between the fan-folded layers or into the lamellar structure, instead of directly into or through the foam layers allows the invention to be reusable.

Description of the Invented Process

The instant invention, the memorial vase insert, improves and simplifies the process of displaying artificial flower arrangements and helium balloons in various sizes of memorial vases. The best mode of the instant invention allows the user to reuse the same memorial vase insert to replace old flower arrangements with new ones. The memorial vase insert is comprised of foam that is fan-folded foam 70 with folded edges on the topside of memorial vase insert. In the best mode of the instant invention, the fan-folded foam is inserted into memorial vase insert. Artificial flowers are inserted in the memorial vase insert by placing floral stems between the foam layers. The foam layers are capable of holding various sizes of floral stems. In addition, the foam layers are also capable of holding wooden or metal dowels for decorative ornaments such as flags. Artificial flower stems can be removed and reinserted within the foam layers without placing holes in foam layers, unlike floral and craft foam where holes are created in the foam each time artificial flowers stems are removed and reinserted. The inventive device is superior to floral and craft foam as to withstanding harsh weather conditions.

In the best mode of the instant invention, the balloon holders provide a convenient place to tie on helium balloons. Floral and craft foams do not offer this much needed feature.

The sleeves are key to the best mode of operation for the instant invention as they allow the vase insert to fit securely in various sizes of memorial vases. The memorial vase insert may be used alone without any sleeves, or with a choice of two different sizes of sleeves: medium and large. Each sleeve or all sleeves can be removed to find the correct fit for the appropriate memorial vase. The sleeves also provide stability of the memorial vase insert inside the memorial vase.

In the best mode, the vase insert rim allows the memorial vase insert to rest on top of memorial vase rim. Without the vase insert rim, the vase insert may possibly fall inside of the memorial vase and/or be difficult to be taken out of the memorial vase once it is inserted.

In the best mode, when inserting artificial flowers in the instant invention before the device is placed inside memorial vase, flower stems will not require cutting prior to insertion process. Once flower stems are inserted into this invention, the stems can be cut from the bottom opening of the memorial vase insert omitting the need to measure the stems length. Using floral and craft foam cones, the floral stems are typically measured and cut to the desired lengths before inserting into the cones. With the described invention floral stems can be arranged to the correct lengths and then cut. Omitting the measuring step saves the user time and unnecessary effort.

The medium and large sleeves allow the memorial vase insert to fit in various sizes of memorial vases. Even though some memorial vases have the same diameter opening, some may have different circumferences throughout the vase. So, for example, two memorial vases can have the same diameter opening but different circumference throughout each vase, so one vase may require a medium sleeve, and the other vase may require both the medium and large sleeve. With the memorial vase insert artificial flowers are more quickly and easily arranged in comparison with floral and craft foam. In addition, time was saved by not having to measure and cut the flower stems before inserting into the memorial vase insert. Cutting flower stems after insertion was a much easier and faster process. Tying on helium balloons to the memorial vase insert balloon holders also proves to be a convenient and easy process.

The process of arranging artificial flowers in the memorial vase insert begins with the selection of artificial flowers and/or greenery. The user can select individual stems and/or bushes. Simply insert each stem and/or bush in between the foam layers. Typically, the center flowers are taller than outer layers of artificial flowers, so the user can pull the center flowers up higher than the rest. Once all flowers have been inserted, without measuring, the floral stems can be cut from the bottom opening of the Memorial Vase Insert.

With respect to the above description then, it is to be realized that the optimum relationships for the parts of the invention, to include variations in materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A memorial vase insert kit comprising:

a vase insert body;

a medium sleeve;

a large sleeve;

a plurality of foam layers;

the vase insert body further having formed thereon a plurality of vase insert wedges;

a vase insert rim;

a bottom rim lip; and a plurality of balloon holders.

2. The memorial vase insert as described in claim 1 wherein the vase insert body is an essentially cylindrical shape with a taper from the larger diameter top of the vase insert body to the narrower bottom of the vase insert body.

3. The memorial vase insert as described in claim 2 wherein the plurality of balloon holders is comprised of two balloon holders.

4. The memorial vase insert as described in claim 3 wherein the medium sleeve and the large sleeve are manufactured from rigid polymeric foam.

* * * * *